United States Patent [19]

Thorn et al.

[11] Patent Number: 4,679,698

[45] Date of Patent: Jul. 14, 1987

[54] FUEL TANK FILLER TUBE RESTRICTOR ASSEMBLY

[75] Inventors: John E. Thorn, Sylvania, Ohio; William W. Burns, Iowa City, Iowa

[73] Assignee: Ford Motor Company, Dearborn, Mich.

[21] Appl. No.: 335,015

[22] Filed: Dec. 28, 1981

[51] Int. Cl.[4] ..... B65B 3/00

[52] U.S. Cl. ..... 220/86 R; 220/85 F

[58] Field of Search ..... 220/85 F, 86 R, 304; 280/5 A; 296/1 C; 285/355, 392, 421; 411/517

[56] References Cited

U.S. PATENT DOCUMENTS

| | | | |
|---|---|---|---|
| 738,445 | 9/1903 | Hoffmann . | |
| 1,296,016 | 3/1919 | Smith . | |
| 1,486,064 | 3/1924 | Warren . | |
| 1,584,868 | 5/1926 | Kutter . | |
| 2,275,067 | 3/1942 | Rheem et al. | 220/214 |
| 2,827,925 | 3/1958 | Meibaum, Jr. | 285/392 X |
| 2,996,317 | 8/1961 | Kibbie et al. | 285/421 X |
| 3,122,383 | 2/1964 | Hirsch | 411/517 X |
| 3,612,338 | 10/1971 | Ekman | 220/86 R X |
| 3,911,977 | 10/1975 | Berger | 220/86 R X |
| 3,917,425 | 11/1975 | Allaben, Jr. . | |
| 4,110,144 | 8/1978 | Buehler et al. . | |
| 4,133,395 | 1/1979 | Schmidt . | |
| 4,185,844 | 1/1980 | Hubbard et al. . | |
| 4,327,783 | 5/1982 | Kanno et al. | 220/86 R X |

*Primary Examiner*—Stephen Marcus

*Assistant Examiner*—Robert M. Petrik

*Attorney, Agent, or Firm*—Peter D. McDermott; Roger L. May

[57] ABSTRACT

A fitting for the end of a fuel tank filler tube such as a plastic, blow molded filler tube in an automotive vehicle comprises:

a flexible band adapted to be inserted into the end of the filler tube to form a locking ring lying against the inside surface of the filler tube, wherein a V-shaped gap between the ends of the locking ring taper to be more narrow in a direction inward the filler tube, the inner surface of the flexible band comprising first engagement means such as, for example, annular or spiral ridges or grooves;

a wedge adapted to be inserted into the V-shaped gap between the ends of the locking ring to force the locking ring tightly against the inside surface of the filler tube; and a restrictor cup comprising a tubular side wall and a restrictor wall with an opening through it, adapted to be inserted into the filler tube, restrictor wall end first, to engage said locking ring, which restrictor cup comprises engagement means such as, for example, annular or sprial grooves or ridges adapted to engage the engagement means of the locking ring.

The wedge is preferably integral with the restrictor cup such that as the restrictor cup is pressed into the end of the filler tube and is engaging the locking ring, the wedge is simultaneously acting upon the locking ring.

30 Claims, 9 Drawing Figures

FUEL TANK FILLER TUBE RESTRICTOR ASSEMBLY

BACKGROUND OF THE INVENTION

This invention relates to a novel fitting for the end of a fuel tank filler tube such as, for example, a fuel tank filler tube of an automotive vehicle.

Government restrictions on the use of leaded fuels have lead to the use of restrictor assemblies in fuel tank filler tubes, generally in the end of the filler tube remote from the fuel tank. Restrictor assemblies are designed to allow insertion into the filler tube of a nozzle of the size employed with unleaded fuel delivery systems, but prevent the insertion into the filler tube of the larger size nozzles used for leaded fuel delivery systems. Various multi-piece restrictor assemblies are known. These, however, typically comprise a large number of parts, resulting in cost disadvantages both in manufacture and assembly. In addition, known restrictor assemblies typically are fabricated at least in part from ferrous or other metals suitable for welding, since restrictor assemblies are most often welded into position for use. The use of such metals results in a relatively heavy assembly and may require costly corrosion protection.

While fuel tank filler tubes have in the past generally been fabricated from ferrous metals, there is presently a trend toward the substitution of synthethic material parts for metal parts. Considerable weight advantage can result which, in the case of automotive vehicles, can lead to improved fuel economy. Exemplary of this trend is the use of plastic, blow molded fuel tank filler tubes. A restrictor assembly suitable for use with such blow molded filler tubes is required.

It is an object of the present invention to provide a restrictor assembly suitable for use with a blow molded synthetic material fuel tank filler tube.

It is a further object of the invention to provide a restrictor assembly which requires few parts, each of which can be fabricated of inexpensive, light weight, corrosion resistant synthetic materials.

It is a further object of the invention to provide a restrictor assembly which can easily be assembled and fitted into a fuel tank filler tube and which, without welding, adhesive or other extraneous attachment means, can provide a positive, fixed engagement between the restrictor assembly and the filler tube to assure against pull-out of the restrictor assembly from the end of the filler tube.

It is a further object of the invention to provide a restrictor assembly to which a closure cap for the filler tube can be mounted to seal the filler tube.

These and other objects and advantages will be evident from the following description of the invention.

BRIEF DESCRIPTION OF THE DRAWINGS

In the drawings, which are not necessarily drawn to scale.

SUMMARY OF THE INVENTION

Figure 1:
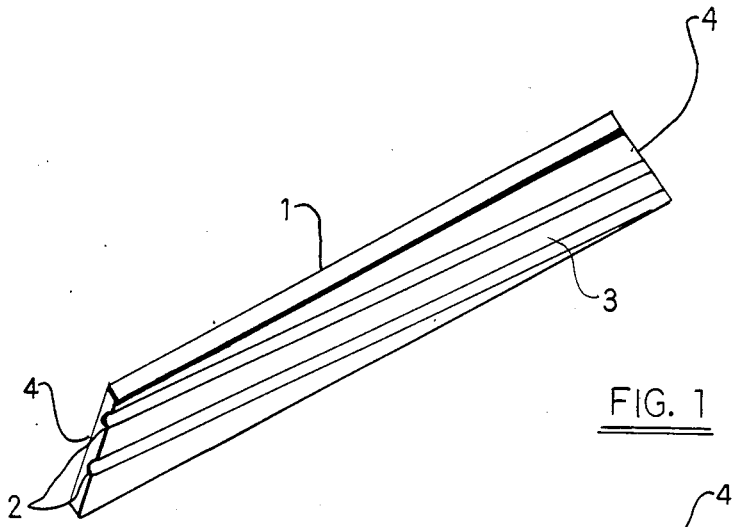
FIG. 1 is a perspective view of a flexible band adapted for use in a restrictor assembly according to the present invention.

According to the present invention, a novel restrictor assembly for a fuel tank filler tube comprises:

A. a flexible band adapted to be inserted into the end of the filler tube to form a locking ring lying against the inside surface of the filler tube and having a V-shaped gap between the ends of the locking ring more narrow in a direction inward the filler tube, the inner surface of the locking ring comprising first engagement means;

B. a wedge adapted to be inserted into the V-shaped gap between the ends of the locking ring to expand the locking ring against the inside surface of the filler tube; and C. a restrictor cup comprising a tubular side wall and a restrictor wall with an opening through it, adapted to be inserted, restrictor wall first, into the filler tube to engage said locking ring, which restrictor cup comprises second engagement means adapted to engage said first engagement means.

In a preferred embodiment of the restrictor assembly of the invention, the wedge described above is integral with the restrictor cup. According to this embodiment, as the restrictor cup is inserted into the filler tube to engage the locking ring, the wedge is simultaneously inserted into the V-shaped gap between the ends of the locking ring to expand the locking ring against the inside surface of the filler tube.

A related aspect of the invention comprises the aforesaid restrictor assembly assembled in a filler tube. According to this embodiment, the restrictor assembly comprises:

A. a tube having an open end;

B. a flexible band within the tube forming a locking ring lying against the inside surface of the tube and having a V-shaped gap between the ends of the locking ring, which gap is more narrow in a direction inward said tube, the inner surface of the locking ring comprising first engagement means;

C. a wedge in said V-shaped gap adapted to expand the locking ring against the inside surface of the filler tube; and D. a restrictor cup positioned substantially coaxially within said tube, comprising a tubular side wall comprising second engagement means engaging said first engagement means, and further comprising a restrictor wall with an opening through it.

Other aspects of the invention will be apparent from the following detailed description of the invention.

DETAILED DESCRIPTION OF THE INVENTION

The locking ring portion of the restrictor assembly of the present invention is formed of a flexible band. In assembling the restrictor assembly, the flexible band is inserted into the open end of a filler tube such that the band is entirely within the filler tube. The flexible band is of such lengths as to form in the filler tube (and, ultimately, in the restrictor assembly) a complete or, preferably, a nearly complete, ring coaxial with the filler tube. The two ends of the flexible band are not square to the longitudinal edges, but rather are at such an angle that the gap existing between them in the restrictor assembly is substantially V-shaped; the gap being more narrow in a direction inward the filler tube.

Preferably, the flexible band is of such configuration that the locking ring formed by the flexible band inside the filler tube cannot readily be pulled out of the filler tube once the restrictor assembly is fully assembled in the filler tube. Preferably, a suitable protrusion such as, for example, an annular tooth, ridge or other protrusion extends radially inward from the inner surface of the filler tube in which the restrictor assembly is to be assembled, and the restrictor assembly is designed such that the flexible band can be inserted below that protrusion to form the locking ring thereunder. In that case, after insertion of the wedge into the V-shaped gap between the ends of the locking ring, thereby causing the locking ring to press tightly against the inner surface of the filler tube, the locking ring could not travel past the protrusion extending from the inner surface of the filler tube. Upon insertion of the restrictor cup into the filler tube and engagement of the restrictor cup with the locking ring, the restrictor assembly could not be pulled out from the end of the filler tube.

Referring now to the drawings, FIG. 1 illustrates an exemplary embodiment of a flexible band suitable to form the locking ring in a restrictor assembly according to the present invention. The flexible band 1 is provided with grooves 2 on its inner surface 3 which, when the flexible band is inserted into the end of a filler tube to form the locking ring, will form a spiral groove on the inside surface of the locking ring suitable to engage corresponding spiral ridges on the outside surface of the side wall of the restrictor cup. The short sides 4 of the flexible band are angled such that upon forming a locking ring inside a filler tube the gap between them will be V-shaped, tapering to be more narrow at the lower end, that is, more narrow in a direction axially inward the filler tube.

Figure 2:
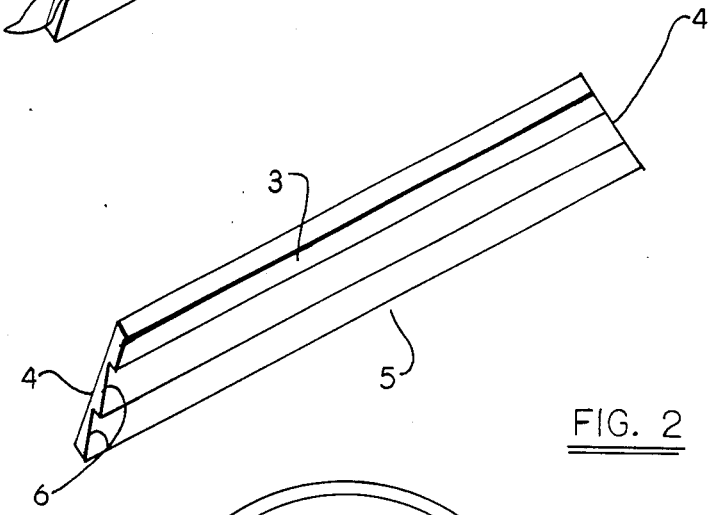
FIG. 2 is a perspective view of a flexible band adapted for use in a restrictor assembly according to the present invention, having a configuration alternative to that of the flexible band of FIG. 1.
Figure 3:
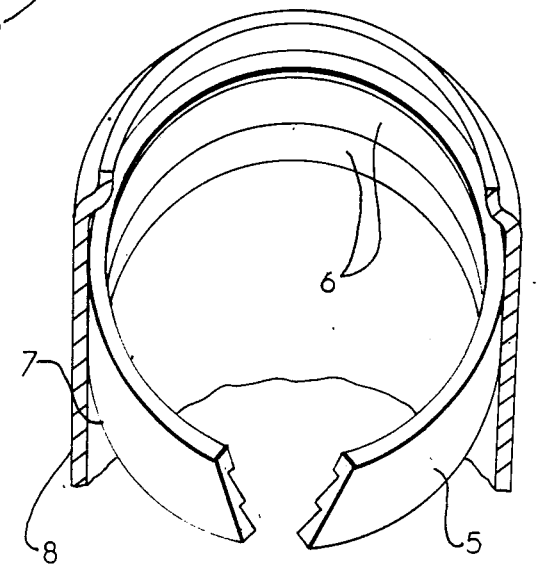
FIG. 3 is a perspective view of the flexible band of FIG. 2 positioned in a fuel tank filler tube according to the present invention.

FIG. 2 shows a flexible band 5 according to the present invention having a configuration alternate to that illustrated in FIG. 1. Flexible band 5 has horizontal grooves 6 in lieu of the sloping grooves 2 of the flexible band illustrated in FIG. 1. The locking ring formed by flexible band 5 would provide, therefore, annular teeth or ridges suitable to engage correspondingly opposed teeth or ridges on the outer surface of the restrictor cup. A locking ring 7 formed by flexible band 5 is illustrated in FIG. 3, wherein a filler tube 8 is shown in section.

Figure 4:
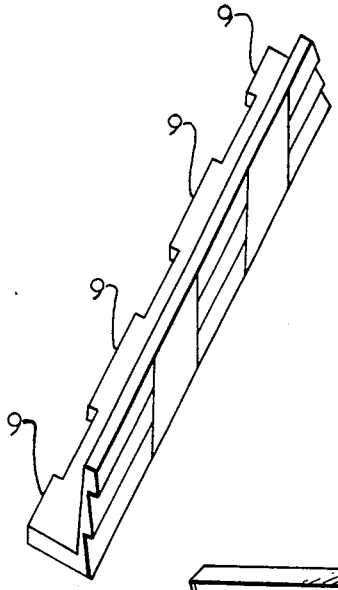
FIG. 4 is a perspective view of a flexible band adapted for use in a restrictor assembly according to a preferred embodiment of the present invention.

In a preferred embodiment, the flexible band comprises a flange, ridge or other protrusion extending radially outward from the outer surface thereof, that is, outwardly from the side which is intended to lie against the inner surface of the filler tube. Such preferred configuration is suitable for use in combination with a filler tube wherein the inner surface of the filler tube is provided with a groove or other recess which corresponds to (that is, is adapted to receive or otherwise engage) said outwardly extending flange of the flexible band. Upon insertion of the flexible band into the filler tube to form the locking ring, the protrusion and corresponding recess engage one another. Subsequently, the wedge can be inserted into the V-shaped gap between the ends of the locking ring, whereby the locking ring is expanded tightly against the inner surface of the filler tube. The outwardly extending flange of the locking ring is thereby prevented from escaping the corresponding recess of the filler tube and thus prevents the locking ring from traveling vertically, that is, along the axis of the filler tube. Consequently, upon insertion of the restrictor cup into the end of the filler tube and engagement of the restrictor cup with the locking ring, the assembled restrictor assembly is prevented from pull-out from the end of the filler tube.

Where it is desired to prevent rotation of the restrictor assembly relative to the filler tube, the flange extending outwardly from the outer surface of the locking ring (and the corresponding groove or other recess in the inner surface of the filler tube) can be intermittent rather than annular as described above. The assembled restrictor assembly would thereby be prevented from rotating in the filer tube. FIG. 4 illustrates a flexible band according to a preferred embodiment, wherein a flange 9 extends outwardly from the outer surface of the locking ring, which flange is intermittent. Accordingly, when used in a restrictor assembly in a filler tube in which the inner surface is correspondingly recessed, the locking ring is prevented from rotating in the filler tube.

The flexible band can comprise any of numerous materials well known to the skilled of the art which are compatable with the fuel(s) to be stored in the fuel tank and which are sufficiently flexible to allow it to be rolled, curled or otherwise collapsed so as to permit it to be inserted into the end of the filler tube. Preferably, the material has sufficient stiffness and memory or spring such that upon rlease inside the filler tube it automatically expands to lie substantially flat against the inner surface of the filler tube. Most preferred are synthetic materials in view of their low cost, corrosion resistance, light weight and ease of fabrication. Suitable synthetic materials include, for example high density polyethylene and, less preferably, suitable phenolics within the skill of the art to select. Alternately, however, relatively thin sheet metal such as steel or other suitable material as may be known to the skilled of the art can be employed for the flexible band. Where metal such as steel is used, it is preferred that it be galvanized or have a terneplate or other protective coating.

The manner of fabrication of the flexible band will depend upon the material from which it is to be made. In the case of the synthetic materials, molding such as, for example, injection molding is preferred in view of the high production rates and low cost provided thereby. Alternately, the flexible band can be extruded using methods well known to the skilled of the art. Where sheet metal is employed, well known stamping techniques can be employed.

Figure 5:
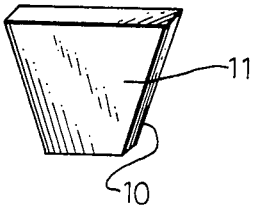
FIG. 5 is a perspective view of a wedge adapted for use in a restrictor assembly according to the present invention.

The wedge component of the restrictor assembly of the present invention comprises a substantially V-shaped portion adapted to be inserted into the V-shaped gap between the ends of the locking ring. FIG. 5 illustrates a simple wedge suitable for use in the restrictor assembly of the present invention. Sides 10 of the wedge are intended to bear against those sides 4 of the locking ring which form the V-shaped gap. It will be obvious to those skilled in the art that means can be provided in the wedge for positively fixing its position once inserted into the locking ring. Thus, for example, ridges or grooves can be provided in the sides 4 of the flexible band which form the V-shaped gap of the locking ring and corresponding grooves or ridges can be provided in sides 10 of the wedge. The planar surface 11 of the wedge, which is intended to face the inside surface of the fuel filler tube in the assembled restrictor assembly, can be flat, as shown in FIG. 5, or curved so as to lie substantially flat against said inside surface of the filler tube.

The wedge and restrictor cup must have corresponding configurations such that the wedge, in the assembled restrictor assembly, does not prevent the insertion of the restrictor cup to engage the locking ring. In one suitable embodiment, the wedge consists simply of a substantially triangular shaped unit having a depth approximately equal to that of the flexible band, such that in the assembled restrictor assembly, the wedge forms a substantially uniform and continuous extension of the radially inward surface of the locking ring formed by the flexible band. In another embodiment, the wedge has a depth greater than that of the flexible band such that the wedge protrudes radially inward beyond the inward surface of the locking ring. In this embodiment, the restrictor cup has a corresponding recess in its outer surface in which that inwardly protruding portion of the wedge fits in the assembled restrictor assembly. It will be recognized that in this embodiment, the restrictor cup is prevented from rotating relative to the locking ring and wedge.

The wedge can comprise any sufficiently rigid material such as, for example, metal or synthethic material. Synthetic materials are preferred in view of the reasons given above. Suitable manufacturing techniques are well known to the skilled of the art and include, for example, molding, extrusion and in the case of metal, casting. More preferably, however, the wedge is formed integrally on the outer surface of the tubular side wall of the restrictor cup. In this fashion, the wedge is properly positioned and inserted into the V-shaped gap in the locking ring as an aspect of positioning and inserting the restrictor cup. It should be recognized that according to this preferred embodiment, the restrictor assembly of the present invention requires only two components: the flexible band and the restrictor cup with integral wedge. In addition, in the assembled restrictor assembly, the restrictor cup is prevented from rotating relative to the locking ring. This embodiment is described further below.

The restrictor cup of the restrictor assembly of the present invention comprises a cup-shaped device having an opening through the bottom wall, that is, through the restrictor wall in that end of the restrictor cup which is inserted first into the filler tube. Where, for example, it is desired to prevent the addition of leaded fuels into a fuel tank through the filler tube, the opening in the restrictor cup is made sufficiently large only to permit insertion of the smaller nozzles typically used in conjunction with lead-free fuel delivery systems but not sufficiently large to permit insertion of the larger nozzles typically used in conjunction with leaded fuel delivery systems.

As in the case of the flexible band and wedge, the restrictor cup can comprise any of numerous materials well known to the skilled of the art which are compatable with the fuel(s) to be stored in the fuel tank, provided such material has sufficient strength, especially impact strength to withstand the stress encounterd in its use environment. The restrictor cup can comprise metal, such as steel, or a synthetic material. If steel is employed, a wedge integral therewith can be formed by stamping methods well known to the skilled of the art. Suitable corrosion protection can be provided as described above for the flexible band. If a synthetic material is used, a wedge integral therewith can be formed according to manufacturing techniques well known to the skilled of the art. Suitable synthetic materials include, for example, high density polyethylene. Metal such as steel or the like is preferred where greater strength and impact resistance are required; synthetic materials may be preferred where light weight and corrosion resistance are more significant.

The restrictor cup is inserted into the end of the filler tube to engage the locking ring formed therein by the flexible band. As described above, the inner surface of the locking ring comprises engagement means. The tubular side wall of the restrictor cup comprises engagement means adapted to engage the engagement means of the locking ring. In one embodiment, the engagement means of the locking ring comprises one or more annular grooves and the engagement means of the restrictor cup comprises one or more mating or matching annular ridges. The annular ridges can be intermittent (and the engagement means of the locking ring correspondingly intermittent) such that the restrictor cup is prevented from rotating relative to the locking ring in the assembled restrictor assembly. Alternately, the engagement means of the locking ring can comprise annular ridges and that of the restrictor cup annular grooves. Alternately, the engagement means of the locking ring comprises a spiral groove or ridge and the engagement means of the restrictor cup comprises a corresponding spiral ridge or groove, respectively. In the latter case, the restrictor cup can be screwed into position in the end of the filler tube. In this case, however, to prevent rotation of the locking ring relative to the filler tube while the restrictor cup is being screwed into position, means preferably are employed as described above for fixing the distance of the locking ring from the end of the filler tube and preventing the restrictor assembly from being pulled out of the filler tube, such as an intermittent annular flange extending outwardly from the outer surface of the locking ring. Of course, the filler tube must provide a correspondingly intermittent annular recess.

Figure 6:
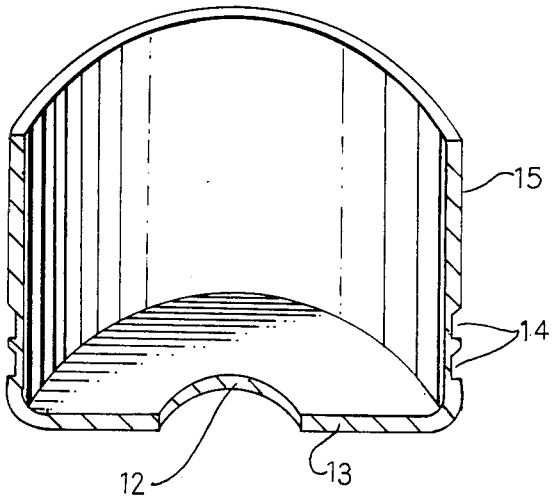
FIG. 6 is a cross-sectional view of a restrictor cup adapted for use in a restrictor assembly according to the present invention.

FIG. 6 illustrates a restrictor cup according to the present invention. An opening 12 is provided through restrictor wall 13, which opening is such as to allow insertion of a nozzle of the size employed with unleaded fuel delivery systems, but which is small enough to prevent insertion of a nozzle of the size employed with leaded fuel delivery systems. Engagement means 14 is provided on the outer surface 15. In the embodiment illustrated, engagement means 14 has such configuration as to be suitable to engage grooves 6 of locking ring 7 illustrates in FIG. 3. Accordingly, a restrictor cup according to the embodiment illustrated in FIG. 6 would be inserted (restrictor wall first) into the end of the filler tube at least sufficiently to engage the locking ring previously formed therein. As noted above, where the engagement means on the inner surface of the locking ring comprises a spiral track, the engagement means provided on the outer surface of the tubular side wall of the restrictor cup would comprise a corresponding spiral track. In this instance, the restrictor cup would be inserted with rotation into the locking ring.

Where the wedge is formed integrally on the outer surface of the restrictor cup, the engagement means of the inner surface of the locking ring and the corresponding engagement means of the outer surface of the restrictor cup preferably comprise corresponding annular tracks such as, for example, matching or mating annular grooves or ridges, rather than spiral tracks, since the protruding wedge could prevent rotation of the restrictor cup into the locking ring. The restrictor cup can in this case be inserted into the filler pipe by first aligning the wedge portion thereof with the V-shaped gap between the ends of the locking ring and then pushing the restrictor cup without rotation into the end of the filler tube. Thus, the wedge is properly inserted into the gap between the ends of the locking ring and the restrictor cup engages the locking ring substantially simultaneously.

Typically, the opening in the restrictor wall of the restrictor cup will simply be a substantially round opening through the center thereof. A straight or curved annular flange can be provided to extend axially from the edge of the opening. In this way, added strength and impact resistance can be achieved.

While the primary function of the restrictor assembly of the present invention is to prevent the addition of improper fuel types into the fuel tank, additional advantageous features are provided, especially according to preferred embodiments of the restrictor assembly of the present invention. Accordingly, the restrictor cup preferably further comprises retainer means suitable to demountably engage a closure cap for the filler tube. Suitably, for example, a portion of the restrictor cup can extend axially outward beyond the end of the filler tube, which extended portion can be threaded to demountably engage a correspondingly threaded closure cap. Thereby, the closure cap can be screwed onto or into the restrictor cup. The outer end of the extended portion of the restrictor cup preferably provides a rim against which the closure gap can bear to form a closing seal.

In addition, the restrictor cup according to a preferred embodiment further comprises means for preventing the restrictor assembly from being inserted beyond a desired depth into the filler tube. This depth limiting means can comprise, for example, an annular flange extending radially outward from the outer surface of the restrictor cup. Thus, the restrictor cup could be inserted into the filler tube only to the point at which such flange contacts the end of the filler tube. Advantageously, such flange can also provide attachment means for mounting and/or positioning the restrictor cup (and indirectly thereby the entire restrictor assembly and the filler tube), for example, to one or more body panels of a vehicle in which the filler tube is to be used.

In addition, a portion of the outer surface of the restrictor cup which is intended to be within the filler tube in the assembled restrictor assembly can be sized to close tolerance with the inside diameter of the filler tube. A seal such as, for example, an "O-ring" gasket seal then can be formed between the filler tube and the restrictor cup. In this fashion, when used in conjunction with a closure cap such as discussed above, the end of the filler tube can be effectively sealed to prevent the escape of fumes or liquid fuel. Of course, it will be apparent in view of the present disclosure that other or additional features can be provided in the present restrictor assembly without departing from the scope of the present invention.

Figure 7:
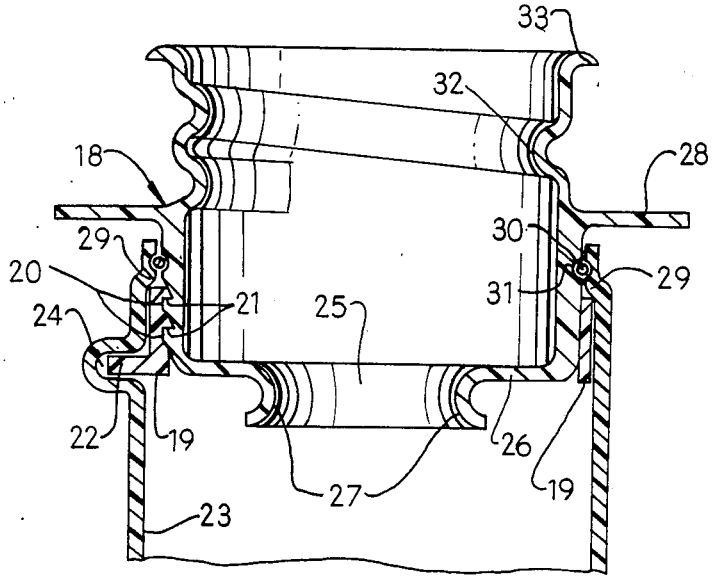
FIG. 7 is a sectional view of a preferred embodiment of the restrictor assembly according to the present invention, shown assembled in the end of a filler tube, wherein the restrictor cup has a configuration alternate to that illustrated in FIG. 6.
Figure 8:
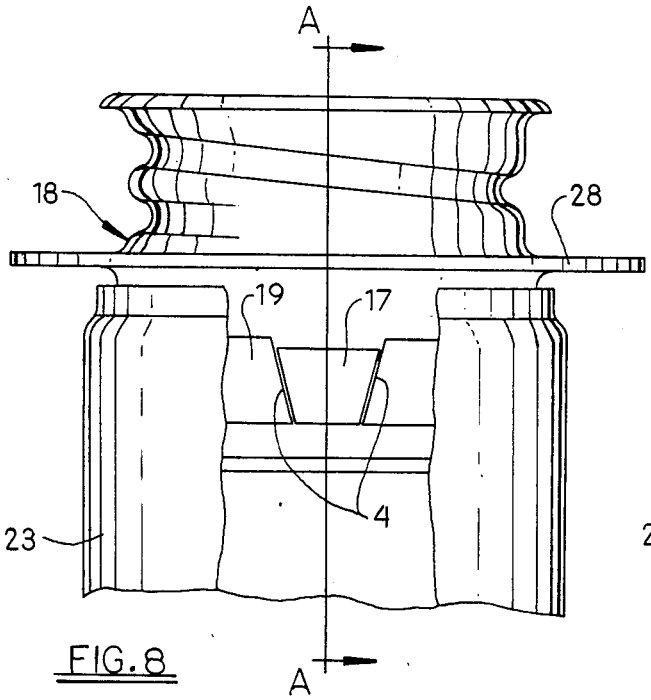
FIG. 8 is an elevation view of the restrictor assembly of FIG. 7, the filler tube being partly broken away, illustrating a wedge in the V-shaped gap between the ends of the locking ring.
Figure 9:
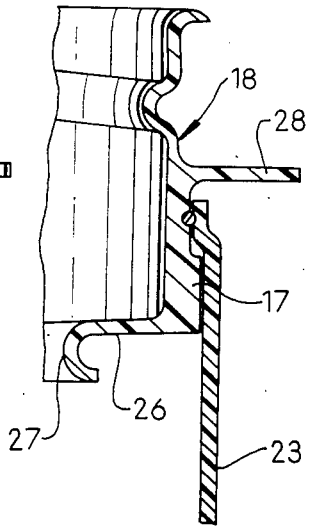
FIG. 9 is a partial view in cross-section of the restrictor assembly of FIG. 8 taken along line A—A, illustrating the wedge to be integral with the tubular end piece.

FIGS. 7–9 illustrate a preferred embodiment of a restrictor assembly according to the present invention, fully assembled in combination with a filler tube. In this embodiment the wedge 17 is formed integrally on the outer surface of restrictor cup 18. Locking ring 19 has intermittent annular grooves 20. That is, grooves 20 are not continuous around the inner surface of the locking ring. Rather, they are provided only in one or more separate segments around the inner surface of the locking ring. Accordingly, therefore, the engagement means 21 provided on the outer surface of the tubular side wall of the restrictor cup is correspondingly intermittent. In this fashion, both the integrally formed wedge and the intermittent engagement means act to prevent rotation of the restrictor cup relative to the locking ring. In a similar fashion, the locking ring comprises a flange 22 extending outwardly from the bottom edge of the locking ring. The flange does not extend from the locking ring in a continuous annular section, but rather extends only in one or more partial annular sections. Naturally, the filler tube wall 23 must provide a concavity 24 to receive flange 22. If the concavity is also intermittent to correspond with the flange, then the locking ring will be prevented from rotating within the filler tube. If, the restrictor cup and locking ring engagement means (and/or the wedge) also prevents rotation of the restrictor cup with respect to the locking ring, as described above, then the entire restrictor assembly will be prevented from rotating relative to the filler tube. Alternate suitable means for preventing rotation of the restrictor assembly of the invention will be apparent to those skilled in the art given the present disclosure. Restrictor cup 18 has opening 25 in restrictor wall 26. Annular flange 27 extends axially inward the filler tube from the perimeter of the opening to provide improved strength and impact resistance. Annular flange 28 extends radially outward from the surface of the restrictor cup above the upper edge of the filler tube. In the preferred embodiment illustrated in the figure it is so positioned as to provide a limit on the depth to which the restrictor cup can be inserted into the filler tube. One or more radial arms or the like could be employed rather than annular flange 28. To some extent, this depth limiting function may be achieved also by flange 22 of the locking ring which also serves to prevent the restrictor assembly from being pulled out from the filler tube. In the embodiment illustrated in FIG. 7, pull-out of the restrictor assembly is also prevented by ledge 29 formed by the filler tube wall. The ledge overhangs the upper edge of the locking ring and thereby prevents it, and indirectly the entire restrictor assembly, from being pulled out from the filler tube.

In the preferred embodiment illustrated in FIGS. 7–9, an "O-ring" gasket 30 is provided. Groove 31 in the outer surface of the restrictor cup receives the gasket and fixes the location of the seal. In addition, engagement means 32 comprising, in the illustrated embodiment, a spiral track is suitable to receive a closure cap (not shown). Such closure cap could be screwed into or onto the restrictor cup such that a surface thereof is brought into contact with bearing rim 33. The closure cap in conjunction with the gasket seal would provide a complete closure of the filler tube to prevent the escape of fumes or liquid fuel.

FIG. 8 illustrates wedge 17 in the assembled restrictor assembly positioned in the V-shaped gap formed by sides 4 of the locking ring 19. FIG. 9 is a cross-sectional view taken through line A—A. In FIG. 9 the restrictor assembly of FIG. 8 is rotated 90°. The wedge is seen to be integral with the restrictor cup.

The restrictor assembly of the present invention is well suited for use in conjunction with synthetic material blow molded fuel tank filler tubes. It can be comprised of synthetic materials and so be inexpensive, light weight and resistant to corrosion. The light weight aids fuel economy when used in fuel filler tubes of automotive vehicles. The corrosion resistance avoids the cost of corrosion prevention steps otherwise required.

Use of the restrictor assembly of the present invention avoids the need for an outside crimp ring since the locking ring formed by the flexible band inside the filler tube can provide a positive lock against pull-out of the restrictor assembly from the end of the filler tube. In addition, it can provide a positive lock against rotation of the restrictor assembly inside the filler tube, which feature is not provided by an outside crimp ring.

A most significant advantage of the restrictor assembly of the invention is the ease with which it can be assembled. The flexible band is simply placed inside the filler tube in the proper location to form the locking ring against the inside surface of the filler tube. The wedge is next inserted into the V-shaped gap between the ends of the locking ring. Finally, the restrictor cup is inserted into the end of the filler tube sufficiently to engage the engagement means provided on the inside surface of the locking ring. Where the wedge is integral with the restrictor cup, the second step is avoided. Thus, it can be seen that the restrictor assembly of the invention can be assembled in as little as two or three steps, either manually or by automated equipment.

Furthermore, the restrictor assembly of the present invention need not be welded, adhesively bonded etc. to the filler pipe. Rather, according to preferred embodiments discussed above, the restrictor assembly of the invention is automatically fixed in position in the end of the filler tube. Other aspects and advantages of the present invention will be apparent to those skilled in the art given the present disclosure.

The restrictor assembly of the present invention need not be utilized with a fuel tank filler tube. Rather, it can also be used where closure or restriction of the opening of any tube is desired for any reason. Thus, for example, where it is desired to completely close the end of a tube, the opening in the restrictor wall of the restrictor cup can simply be deleted. In addition, while several specific embodiments of the invention have been described and illustrated in detail, the present invention is not limited to these specific embodiments. Rather, it will be understood and obvious to those skilled in the art given the present disclosure that the invention can be embodied otherwise without departing from the principles of the invention.

We claim:

1. A restrictor assembly for the end of a filler tube, which comprises:

A. a flexible band adapted to be inserted into the end of the filler tube to form a locking ring lying against the inside surface of the filler tube and having a V-shaped gap between the ends of the locking ring more narrow in a direction axially inward said filler tube, the inner surface of the flexible band comprising first engagement means;

B. a wedge adapted to be inserted into said V-shaped gap to expand the locking ring against the inside surface of the filler tube; and C. a restrictor cup comprising a tubular side wall and a restrictor wall with an opening through it, adapted to be inserted, restrictor wall first, into the filler tube to engage said locking ring, which restrictor cup comprises second engagement means adapted to engage said first engagement means.

2. A restrictor assembly as in claim 1 wherein the wedge has a depth greater than that of the flexible band and said restrictor cup has a recess in the outer surface of said tubular side wall adapted to receive such portion of the wedge as protrudes radially inward beyond the inward surface of the locking ring.

3. A restrictor assembly as in claim 1 wherein the wedge is integral with the restrictor cup.

4. A restrictor assembly as in claim 1,2, or 3 wherein said first engagement means comprises one or more annular grooves or ridges and said second engagement means comprises one or more corresponding annular grooves or ridges.

5. A restrictor assembly as in claim 1 wherein said first engagement means comprises a spiral track and said second second engagement means comprises a corresponding spiral track.

6. A restrictor assembly as in claim 1 wherein an annular flange extends axially inward said filler tube from the edge of the opening in said restrictor wall of the restrictor cup.

7. A restrictor assembly as in claim 1 wherein said restrictor cup further comprises cap-retainer means adapted to demountably receive a closure cap for the filler tube.

8. A restrictor assembly as in claim 7 wherein said cap-retainer means comprises a spiral track adapted to engage a corresponding spiral track of said closure cap.

9. A restrictor assembly as in claim 8 wherein the restrictor cup further comprises a continuous rim against which the closure cap can bear to form a seal therewith.

10. A restrictor assembly as in claim 1 wherein said restrictor cup further comprises means for limiting the depth of insertion of the restrictor cup into the filler tube.

11. A restrictor assembly as in claim 10 wherein said depth limiting means comprises an annular flange extending radially outward from the outer surface of the tubular side wall of said restrictor cup.

12. A restrictor assembly as in claim 1 wherein the flexible band further comprises means for fixing the distance of the locking ring from said end of the filler tube.

13. A restrictor assembly as in claim 12 wherein said means for fixing the distance of the locking ring from said end of the filler tube comprises an annular flange extending radially outward from the outer surface of said locking ring.

14. A restrictor assembly as in claim 13 wherein said annular flange is an intermittent annular flange.

15. A restrictor assembly as in claim 1 further comprising a gasket adapted to seal the outside surface of the tubular side wall of the restrictor cup to the inside surface of the filler tube.

16. A restrictor assembly comprising:

A. a filler tube having an open end;

B. a flexible band within the tube forming a locking ring lying against the inside surface of the tube and having a V-shaped gap between the ends of the locking ring, which gap is more narrow in a direction inward said tube, the inside surface of the locking ring comprising first engagement means;

C. a wedge in said V-shaped gap adapted to expand the locking ring against the inside surface of the filler tube; and D. a restrictor cup positioned substantially coaxially within said tube, comprising a tubular side wall comprising second engagement means engaging said first engagement means; and further comprising a restrictor wall with an opening through it.

17. A restrictor assembly as in claim 16 wherein the wedge has a depth greater than that of the flexible band and the restrictor cup has a recess in the outer surface of said tubular side wall receiving such portion of the wedge as protrudes radially inward beyond the inside surface of the locking ring.

18. A restrictor assembly as in claim 16 wherein the wedge is integral.

19. A restrictor assembly as in claim 16, 17 or 18 wherein said first engagement means comprises one or more annular grooves or ridges and said second engagement means comprises one or more corresponding annular grooves or ridges.

20. A restrictor assembly as in claim 16 wherein said first engagement means comprises a spiral track and said second engagement means comprises a corresponding spiral track.

21. A restrictor assembly as in claim 16 wherein an annular flange extends from the edge of the opening in said bottom wall of the restrictor cup.

22. A restrictor assembly as in claim 16 wherein said restrictor cup further comprises cap-retainer means adapted to demountably receive a closure cap for the filler tube.

23. A restrictor assembly as in claim 22 wherein said cap-retainer means comprises a spiral track suitable to engage a corresponding spiral track of said closure cap.

24. A restrictor assembly as in claim 23 wherein the restrictor cup further comprises a continuous rim against which the closure cap can bear to form a seal therewith.

25. A restrictor assembly as in claim 16 wherein the restrictor cup further comprises means for limiting the depth of insertion of the restrictor cup into the filler tube.

26. A restrictor assembly as in claim 25 wherein said depth limiting means comprises an annular flange extending radially outward from the outer surface of the tubular side wall of the restrictor cup.

27. A restrictor assembly as in claim 16 wherein the flexible band further comprises means for fixing the distance of the locking ring from said end of the filler tube.

28. A restrictor assembly as in claim 27 wherein said means for fixing the distance of the locking ring from said end of the filler tube comprises an annular flange extending radially outward from the outer surface of said locking ring.

29. A restrictor assembly as in claim 28 wherein said annular flange is an intermittent annular flange.

30. A restrictor assembly as in claim 1 further comprising a gasket adapted to seal the outside surface of the tubular said wall of the restrictor cup to the inside surface of the filler tube.

* * * * *